US006109274A

United States Patent [19]

Ingersoll

[11] Patent Number: 6,109,274

[45] Date of Patent: Aug. 29, 2000

[54] METHOD FOR ATTACHING COMMERCIAL HAIR

[76] Inventor: Jacqueline Donovan Ingersoll, 2045 Space Park Dr., Suite 235, Nassau Bay, Houston, Tex. 77058

[21] Appl. No.: 09/430,628

[22] Filed: Oct. 29, 1999

Related U.S. Application Data

[60] Provisional application No. 60/106,544, Nov. 2, 1998.

[51] Int. Cl.[7] ..... A41G 3/00; A45D 24/00

[52] U.S. Cl. ..... 132/201; 132/53; 132/56; 132/200

[58] Field of Search ..... 132/201, 200, 132/53, 54, 55, 56

[56] References Cited

U.S. PATENT DOCUMENTS

| | | | |
|---|---|---|---|
| 2,621,663 | 12/1952 | Jenkins | 132/5 |
| 3,530,862 | 9/1970 | Hudson | 132/201 |
| 3,553,737 | 1/1971 | Bauman | 132/201 |
| 3,605,761 | 9/1971 | Margo | 132/5 |
| 3,760,818 | 9/1973 | Schweifer | 132/1 R |
| 3,809,099 | 5/1974 | Goldberg et al. | 132/53 |
| 3,835,868 | 9/1974 | Heck | 132/201 |
| 3,871,389 | 3/1975 | Bauer | 132/53 |
| 3,889,694 | 6/1975 | Greer | 132/53 |
| 4,168,713 | 9/1979 | Agiotis | 132/53 |
| 4,771,798 | 9/1988 | Cardino | 132/53 |
| 5,033,486 | 7/1991 | Finamore et al. | 132/201 |
| 5,107,867 | 4/1992 | Barrington | 132/201 |
| 5,154,195 | 10/1992 | Irisawa | 132/201 |
| 5,357,986 | 10/1994 | Hargrett | 132/201 |
| 5,607,479 | 3/1997 | Jones et al. | 623/15 |
| 5,855,211 | 1/1999 | Nelson | 132/53 |

*Primary Examiner*—John J. Wilson
*Assistant Examiner*—Robyn Kieu Doan
*Attorney, Agent, or Firm*—Laura M. Peebles

[57] ABSTRACT

The invention is a method of attaching commercial hair to a wearer's head. The method includes the steps of gathering several strands of the wearer's natural hair into a first tuft; feeding the first tuft through a hole in a first linking attachment member; gathering several more strands of hair into a second tuft and feeding it through the hole in the opposite direction. Then the hair is secured in the linking member by crimping. Next, further strands of natural hair are added to the first tuft creating a third tuft, which are fed through a hole in a second linking attachment member creating a securing base of hair between and with the linking members. Then the commercial hair is attached to the securing base.

11 Claims, 2 Drawing Sheets

METHOD FOR ATTACHING COMMERCIAL HAIR

This application is a provision of Ser. No. 60/106,544 filed Nov. 2, 1998.

BACKGROUND OF THE INVENTION

The present invention relates to a method of attaching commercial hair. More particularly, this invention relates to attaching commercial hair or a hair system to already existing natural hair on a wearer's head by means forming a securing base in the wearer's hair with use of a plurality of linking attachment members.

Tens of millions of men and women in America alone suffer hair loss to some degree. In fact, studies indicate that losing hair is more common than not losing hair. About two-thirds of those who lose hair are experiencing androgenetic alopecia, or male or female pattern baldness. Male pattern baldness first begins as a thinning of the hair, beginning at the front hairline or the crown. Then it spreads until, in extreme cases, the person is left with only a thin "horseshoe" fringe of hair around the sides and the back.

Commercial hair and hair systems are conventional methods for covering regions of hair loss. "Commercial hair" is defined as any material that is artificially attached to a person's head to create the appearance of human hair. Commercial hair includes human, animal hair as well as synthetic fibers and hair wefts.

Commercial hair has typically been attached to the wearer's natural hair by means of adhesives, clips and the like. However, as the natural hair grows or gets dirty, the commercial hair needs to be removed for cleaning and then replaced and refitted onto the wearer's head.

If adhesives are used, the commercial hair must be cut from the wearer, which results in the undesirable loss of more hair. Further, it is uncomfortable for the wearer since the adhesive can be irritating and does not allow normal respiration of the head. Further, some wearers develop allergic reactions to the adhesives. Additionally, the adhesive may melt in extreme situations, resulting in a loosening of the commercial hair.

Other methods of attaching commercial hair are generally bulky and result in a noticeable ridge along the natural hairline under the commercial hair. This does not provide a natural looking appearance. Further, the attachment methods may not be adequately secure, allowing the commercial hair to be displaced during activities such as swimming, showering, or walking in heavy winds.

SUMMARY OF THE INVENTION

The present invention is a method of attaching commercial hair onto a wearer's natural hair using linking attachment members to form a securing base on the wearer, and then attaching the commercial hair onto the securing base.

In a preferred embodiment of the invention, the method includes the steps of feeding a tuft of hair into a linking member and then feeding a second tuft of hair through the opposite end of the linking member. The linking member is then crimped to hold it in place. The first tuft extends beyond the linking member and is added to additional natural hair to form a third tuft. This third tuft is then fed through a second linking element. This combination of hair tufts and linking elements forms a securing base in the natural hair that is to be covered by the commercial hair. The commercial hair is then attached to the securing base.

Accordingly, it is an object of the present invention to provide a method for attaching commercial hair in which a securing base of hair is formed; a system in which linking attachment members are used to hold the wearer's natural hair; a system in which the commercial hair gives a more comfortable, natural looking appearance; a system which lessens irritation and undesirable hair loss; and a system which does not involve direct skin contact and provides better air and moisture flow to the wearer so that the system is cooler.

Other objects and advantages of the present invention will be apparent from the following description, the accompanying drawings and the appended claims.

DETAILED DESCRIPTION

Figure 1:
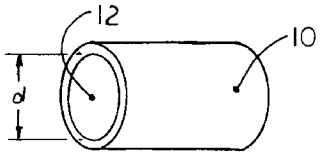
FIG. 1 is a front elevational view of an exemplary linking member of the present invention.

FIG. 1 shows a linking attachment member generally designated 10 in accordance with the present invention. In a preferred embodiment of the invention, the linking member 10 is cylindrical in shape having a hole 12 therethrough. The hole has a diameter d such that an adequate number of hair strands may be fed through along with a tool member, but not large enough that it makes the linking member large and bulky. The linking member also must have a dimension such that it is large enough to be handled and utilized by the person applying them. Further, the linking member must not be so large that it does not hold the natural hair securely. Preferably, the linking member 10 has a length of about 2 mm to about 5 mm, more preferably it is about 2.5 mm in length. Preferably, the linking member 10 has a diameter of about 1.5 mm to about 3 mm, more preferably the diameter is about 2.25 mm. It must be noted that while a cylindrical linking member is shown here, the member may be another shape such as rectangular or oblong.

The linking member is preferably made of a malleable material for reasons that will be established hereinbelow. Metals and moldable plastics are particularly preferred as well as combinations thereof. Exemplary metals include aluminum and silver. Metal is advantageous as it may be shaped or crimped to hold the hair in a stable relationship and it can be reshaped to be opened to release the hair for replacement and tightening. An example of a linking member is MICROLINKS which is distributed by companies such as New Concepts, International Hair Inc. (I.H.I.) and On Right.

In the method described herein, a plurality of linking members are placed around the periphery of the wearer's natural hairline. However, the same method may be used to place the linking members in a crisscross pattern across the head or to spot place at different areas (i.e., to reinforce the center of where the commercial hair will be placed.) Preferably, the positions where the linking members will be placed are marked on the wearer's head. This can be done with a permanent marker or wax pencil. The number and placement of the linking members will vary depending on the size and shape of the wearer's head as well as the extent of the hair loss and size and shape of the commercial hair that will be attached.

Figure 2:
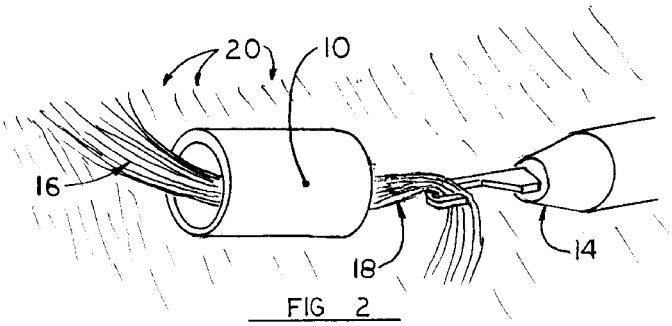
FIG. 2 is a diagram of a hair tuft being fed through the linking member of FIG. 1.

After the desired positions have been marked, the linking members will be applied. As shown in FIG. 2, a hook or needle 14 may be used to grasp several strands 16 of the wearer's natural hair, forming a first tuft of hair 18. The linking member 10 is held at one of the marked positions, such that the hole 12 is parallel to the hairline 20 and this first tuft 18 is drawn through the hole 12 in the linking member. The ends of the strands of hair of the first tuft 18 extend beyond the end of the linking member. It must be noted that the linking members could also be placed perpendicular to the hairline. Further, if the securing base is not following the periphery of the hairline, such as in the criss-cross pattern, the hole 12 in the linking member will also not necessarily be parallel to the hairline.

Figure 3:
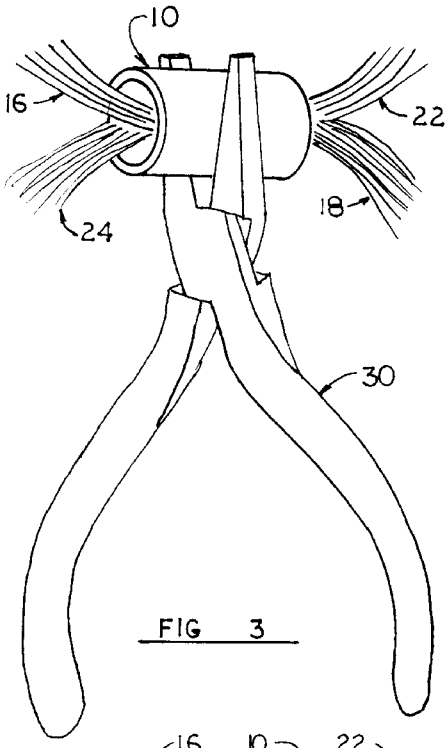
FIG. 3 shows a second tuft of hair drawn through the linking member and the crimping step.

Next, in a preferred embodiment of the present invention, the hook or needle 14 is used to grab several more strands of natural hair 22 from the opposite side of the linking member 10 as shown in FIG. 3, forming a second tuft of hair 24. This second tuft is fed through the hole 12 in the linking member in a direction opposing that of the first tuft 18. This step is used to add stability to the linking element and may not be necessary.

The linking member 10 is then crimped or flatted with a tool such as pliers 30. This pinches the metal of the linking member so that it holds the tufts of hair 18,24 securely in place and prevents any substantial movement of the linking member. In addition, if desired, a small drop of adhesive could be used to hold the linking member. Before crimping, the linking member is brought out several millimeters from the head. This prevents pulling on the wearer's head.

Figure 4:
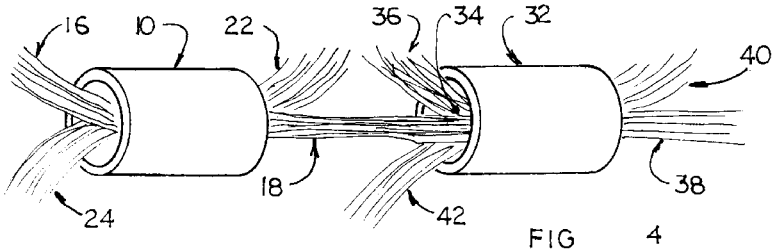
FIG. 4 is a series of hair tufts and linking members forming a securing base.

Next, as shown in FIG. 4, a second linking member 32 is held at the next marked position on the wearer's hair. It is held in a position similar to the first, i.e., the hole 34 is generally parallel to the wearer's natural hairline if the periphery of the natural hairline is being followed. Several more strands of natural hair 36 are grasped and added to the extending strands of the first tuft of hair 18. This forms a forth tuft 38 of hair. This forth tuft of hair 38 is fed through the hole 34 in the second linking member 32. Again, this fourth tuft extends through the second linking member 32 and is subsequently used if necessary. If Is additional support is desired, a fifth tuft 40 of hair is gathered from the opposing end of the second linking member 32 and fed through the hole 34 in the opposing direction. Then this second linking member is crimped so that it is held securely in place.

The extending portion of the forth tuft 38 of hair is added to additional strands of natural hair and are fed through the third linking member 50 which is held at a third marked location on the wearer's hairline 20.

Figure 5:
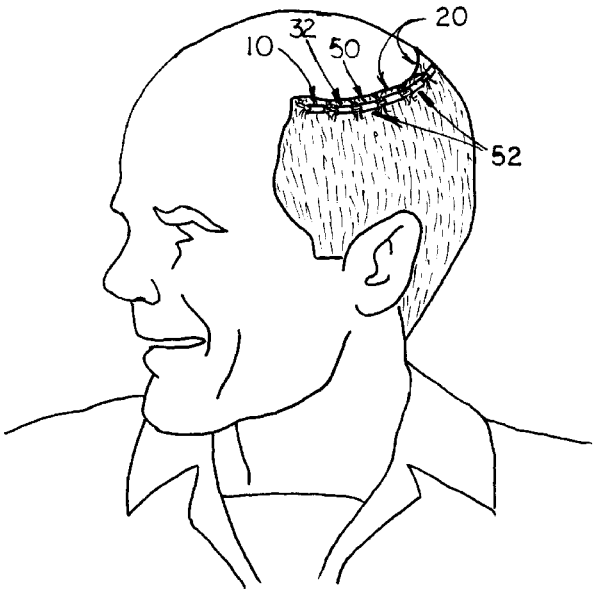
FIG. 5 is a wearer having the securing base along the hairline.

These steps are continued until all of the required linking members have been placed. This set of linking members and natural hair forms a securing base 52 of hair. If the wearer has natural hair remaining in the forehead region, the linking members can be placed in a circular pattern forming a ring. If the wearer's natural hair only remains in a horseshoe pattern as shown in FIG. 5, the linkages are placed where natural hair is available. If the hair is thin all over, the securing base may be formed as a criss-cross on the head, and if only certain areas need reinforcing, the securing base will be spot placed in those areas.

Linking members may be placed singly or plurally at each marked position as needed. This can be determined by the availability of hair in any given area. Linking members may sometimes be required to be attached one after the other horizontally with minimal space in between forming a linking band. This is advantageous in area where the commercial hair may loosen such as the front hairline. The same tuft of hair is fed through all linking members.

Figure 6:
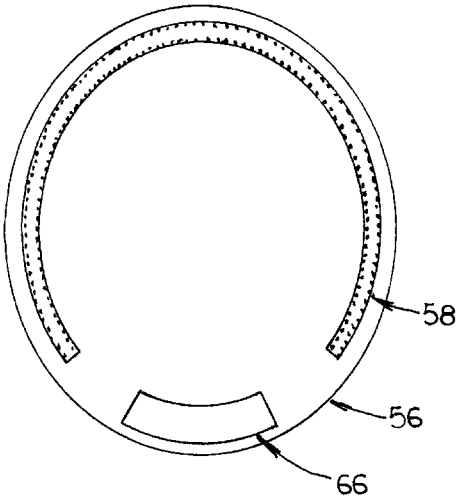
FIG. 6 show a sample of commercial hair having an attachment ribbon.

After the securing base 52 has been established, the commercial hair 56 may be attached. The commercial hair 56, such as the example shown in FIGS. 6 and 7 may be made according to any of the conventional methods as are known in the art and does not constitute a portion of this invention. A heavy gauge thread, filament edge or ribbon edge 58 is preferably placed along the periphery of the commercial hair in the position where it will be attached to the head. FIG. 6 shows a ribbon 58 that has been sewn onto the commercial hair 56. This thread or ribbon provides a place for the commercial hair to be attached to the securing base 52. If a thread or ribbon is not used, the commercial hair is sewn to the web material of the commercial hair. However, sewing onto the web material has a disadvantage in that it may form holes or cause excessive wear in those areas, decreasing the useful life of the commercial hair. Some commercial hairpieces have a plurality of holes around their periphery.

Figure 7:
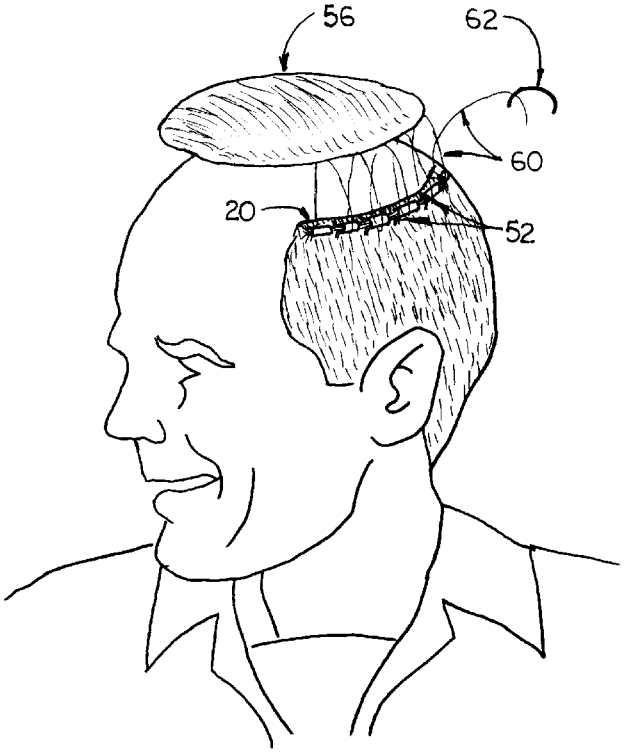
FIG. 7 shows the commercial hair being attached to the wearer's head.

In a preferred method of the present invention, a sturdy thread 60 such as carpet thread or thread which is normally used for bullet proof vests, is threaded onto a needle or similar tool 62, such as a curved needle such in FIG. 7. The thread should preferably match the color of the wearer's natural hair so that it cannot be detected. The thread 60 is knotted at one of linking elements on the securing base. Then the thread is fed around the hair tufts in the securing base or through a linking member and through the thread or ribbon 58 or provided hole on the commercial hair 56. The thread 60 is knotted back through itself and stitched in. This is continued until the commercial hair is attached at each linking member along the securing base 52. If desired, the thread may be wrapped around the needle 62 and knotted at each linking member for a more secure hold and to ensure the thread 60 will stay in place if it should break at a given position.

In order to secure the front of the commercial hair if there are no natural hairs for attachment of the linking members, adhesive members 66 may be used as shown in FIG. 6. These adhesive members are attached to the wearer's head and the underside of the commercial hair. Further, any combination of bonding, taping and linking members may be used to secure the natural hair.

The commercial hair will need to be removed occasionally for cleaning and tightening as the natural hairs grow out. In order to remove the commercial hair, the thread 60 is clipped and removed. Then the linking elements are opened using a pliers or similar tool. The tufts of hair can then be pulled through the holes.

To tighten the natural hair with respect to the linking element, the linking element is then refastened by crimping with the tool. While the linking member may be refastened, preferably, they are disposed of and a new linking member is used to form a completely new securing base. If the linking member should break or needs to be replaced, it can simply be slid off of the tufts of hair and replaced by a new linking element. There is no need to cut the wearer's natural hair out of the attaching linking element or to remove any adhesive. This is quite advantageous since no additional hair need to be unnecessarily lost. The wearer can then have their natural hair shampooed and trimmed and the commercial hair washed and treated before it is replaced.

In order to replace the commercial hair, a new thread such as that shown in FIG. 7 at 60 is used to sew the commercial hair onto the commercial hair as described above.

Having described the invention in detail and by reference to preferred embodiments thereof, it will be apparent that modifications and variations are possible without departing from the scope of the invention defined in the appended claims.

What is claimed is:

1. A method for attaching commercial hair comprising the steps of:

a) providing a wearer having natural hair; a plurality of malleable linking attachment members each having a hole therethrough; and commercial hair;

b) gathering several strands of said natural hair into a first tuft;

c) feeding said first tuft through said hole in a first linking attachment member;

d) gathering a second set of strands of natural hair and feeding said second set of strands through an opposing side of said hole in said first linking member;

e) securing said first linking attachment member to said first tuft by crimping;

f) adding further strands of said natural hair to said first tuft creating a second tuft;

g) feeding said second tuft through said hole in a second linking attachment member creating a securing base of hair between said linking members; and h) attaching said commercial hair to said securing base.

2. The method of claim 1 wherein before said step of attaching said commercial hair, adding further strands of natural hair to said second tuft creating a third tuft, feeding said third tuft through a hole in a third linking member such that additional securing base of hair is created.

3. The method of claim 2 wherein before said step of attached said commercial hair, creating further tufts of hair and feeding said further tufts of hair through further linking members, resulting in a securing base which follows a periphery of said wearer's hairline.

4. The method of claim 1 wherein said step of feeding said first tuft through said hole includes the step of placing said strands of natural hair onto a hooking element and pulling said hooking element through said hole in said linking member.

5. The method of claim 1 wherein said plurality of malleable linking attachment members are cylindrical having a hole therethrough.

6. The method of claim 5 wherein said linking attachment members have diameters in the range of about 2.25 to about 3.0 mm.

7. The method of claim 5 wherein said linking attachment members comprise aluminum, silver, plastic or combination thereof.

8. The method of claim 1 wherein said step of attaching said commercial hair to said securing base comprises the steps of:

providing a thread; and sewing said securing base to said commercial hair.

9. The method of claim 8 wherein said commercial hair further comprises a commercial hair attachment piece, such that said step of sewing said securing base to said commercial hair involves using said thread to connect said securing base to said commercial hair attachment piece.

10. The method of claim 9 wherein said commercial hair attachment piece is a thread or thin ribbon which is sewn along the periphery of an underside of said commercial hair.

11. The method of claim 1 further comprising the step of marking the head of said wearer to denote desired positions of said linking attachment members prior to gathering said several strands of natural hair into said first tuft.

* * * * *